United States Patent [19]

Grimmer

[11] 4,188,921

[45] Feb. 19, 1980

[54] METHOD AND APPARATUS FOR DEFINING DURATION OF FUEL INJECTION CONTROL PULSES

[75] Inventor: Franz Grimmer, Schwieberdingen, Fed. Rep. of Germany

[73] Assignee: Robert Bosch GmbH, Stuttgart, Fed. Rep. of Germany

[21] Appl. No.: 916,170

[22] Filed: Jun. 16, 1978

[30] Foreign Application Priority Data

Aug. 6, 1977 [DE] Fed. Rep. of Germany ..... 2735595

[51] Int. Cl.[2] ..... F02B 3/00; F02P 3/00

[52] U.S. Cl. ..... 123/32 EA; 123/117 R

[58] Field of Search ..... 123/32 EA, 32 ED, 119 EC, 123/117 R, 117 D

[56] References Cited

U.S. PATENT DOCUMENTS

| | | | |
|---|---|---|---|
| 3,548,792 | 12/1970 | Palmer | 123/32 EA |
| 3,688,750 | 9/1972 | O'Neill | 123/32 EA |
| 3,785,356 | 1/1974 | Niemoeller | 123/117 R |
| 3,796,197 | 3/1974 | Locher et al. | 123/117 R |
| 3,858,561 | 1/1975 | Aono | 123/32 EA |
| 3,889,647 | 6/1975 | Rachel | 123/32 EA |
| 4,005,688 | 2/1977 | Kawai et al. | 123/117 R |
| 4,015,566 | 4/1977 | Wahl | 123/117 R |
| 4,047,507 | 9/1977 | Noguchi et al. | 123/32 EA |
| 4,136,645 | 1/1979 | Ito et al. | 60/285 |

*Primary Examiner*—Charles J. Myhre
*Assistant Examiner*—P. S. Lall
*Attorney, Agent, or Firm*—Edwin E. Greigg

[57] ABSTRACT

In an internal combustion engine employing intermittent, pulse-controlled fuel injection, the amount of fuel, i.e. the duration of the control pulses is made dependent at least on engine speed and the degree of opening of the throttle plate. These variables are converted to electrical signals which are used to generate an approximation of the optimum pulse duration values as a succession of linear approximations added to an initial value. The throttle angle signal is fed into an amplifier that limits the output signal above a certain value of throttle opening, e.g. 50°. The speed signal feeds into a ramp generator and the throttle signal controls an initial value generator. The outputs from these generators are summed and compared with a maximum value and at least one minimum selector selects the lower of these values for use as the injection control signal.

6 Claims, 5 Drawing Figures

$t_i$/ms
5
4
3
2
1
0
ENGINE PERIOD / MILLISECONDS
40°
30°
25°
20°
15°
12°
10°
8°
6°
5
10
15
20
25
T/ms
FUEL INJECTION CONTROL PULSE DURATION / MILLISECONDS a)
INITIAL PULSE DURATION (MILLISECONDS)
$t_{io}$/ms
2
1
0
10
20
30
40
50
60
α
THROTTLE OPENING ANGLE
b)
m
CURVE SLOPE (FIG. 1.)
2
1
0
10
20
30
40
50
60
α
THROTTLE OPENING ANGLE
c)
$t_{imax}$/ms
5
2
0
FUEL INJECTION PULSE DURATION (MAXIMUM)
10
20
30
40
50
60
α
TROTTLE OPENING ANGLE a)

INITIALIZING CIRCUIT (16)

b)

RAMP GENERATOR (17)

c)

EXPONENTIAL GENERATOR (26)

METHOD AND APPARATUS FOR DEFINING DURATION OF FUEL INJECTION CONTROL PULSES

BACKGROUND OF THE INVENTION

The invention relates generally to the fuel management of internal combustion engines. More particularly, the invention relates to a method and an apparatus for providing control signals to actuate fuel injection valves in fuel-injected internal combustion engines. The invention relates directly to a method and apparatus for defining the duration of actuation of the fuel injection valves on the basis of engine variables, in particular on the basis of the prevailing engine speed (rpm) and the prevailing throttle butterfly valve angle which defines the degree of opening of the throttle. The optimum amount of fuel to be provided to the engine for every operational state is determined in advance, for example by experiments, and the apparatus according to the invention provides fuel injection control pulses which approximate the desired amount of fuel for every engine state. Known in the art are mechanisms which approximate the injection time on the basis of engine variables which are transduced in a relatively coarse and imprecise manner. These known installations have been found to be expensive and subject to a large number of malfunctions.

OBJECT AND SUMMARY OF THE INVENTION

The present invention has as one of its principal objects the provision of a method and an apparatus for generating fuel injection control pulses, the length of which corresponds to empirically derived data regarding the injection time. It is a further oject of the invention to provide a method and apparatus for generating fuel injection pulses which is universally applicable to all manner of injected engines and which is further capable of easy exchange. Still another object of the invention is to provide a method and apparatus for generating fuel injection control pulses by a plurality of linear approximations and with only minimal deviations from the optimum, predetermined control data.

The invention will be better understood as well as further objects and advantages thereof become more apparent from the ensuing detailed description of a preferred exemplary embodiment which is to be read in conjunction with the drawing.

DESCRIPTION OF THE PREFERRED EMBODIMENT

Figure 1:
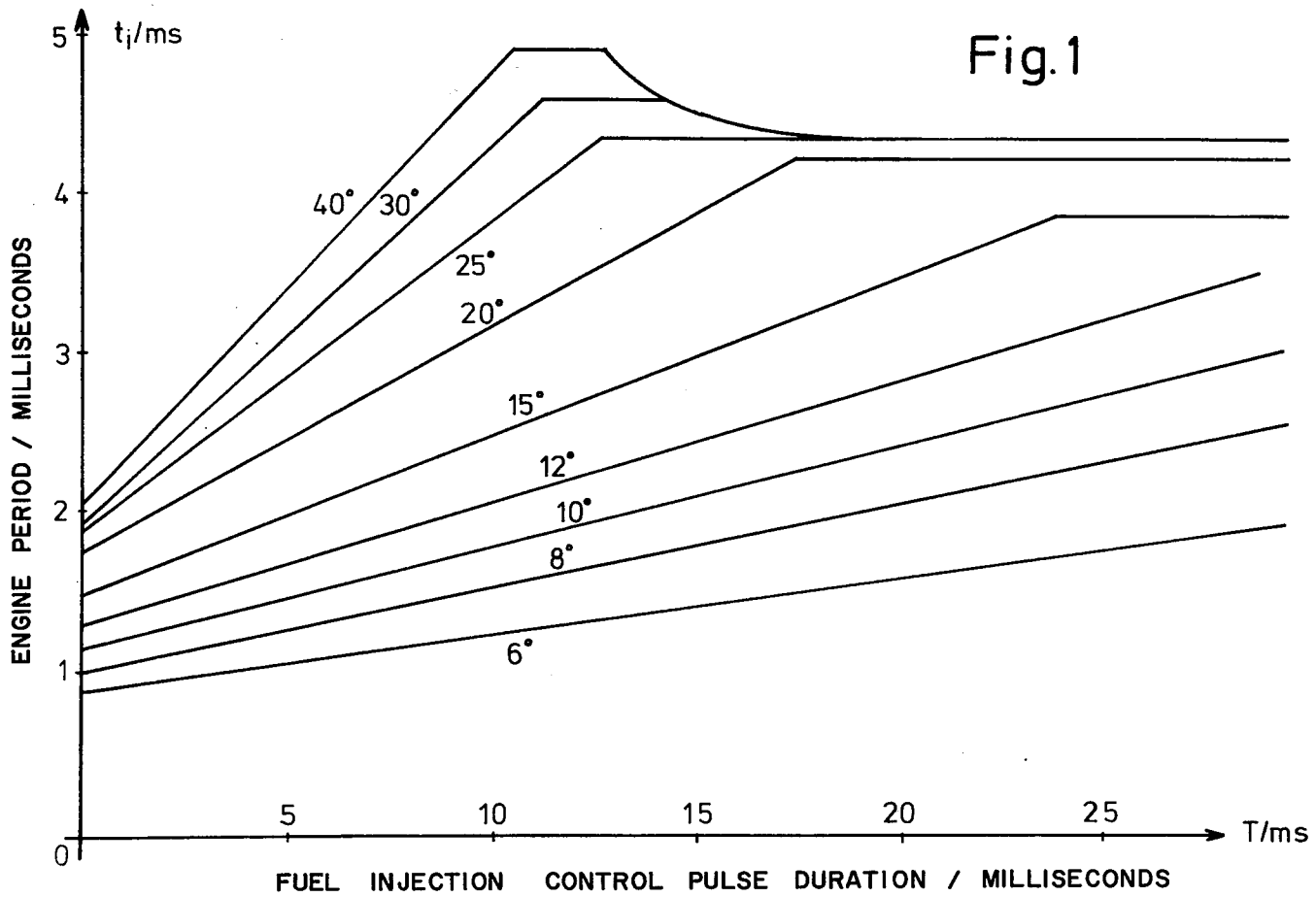
FIG. 1 is a diagram illustrating a family of curves representing fuel injection pulse durations plotted as a function of engine speed plotted as period, the common parameter being the degree of opening of the throttle valve.
Figure 2:
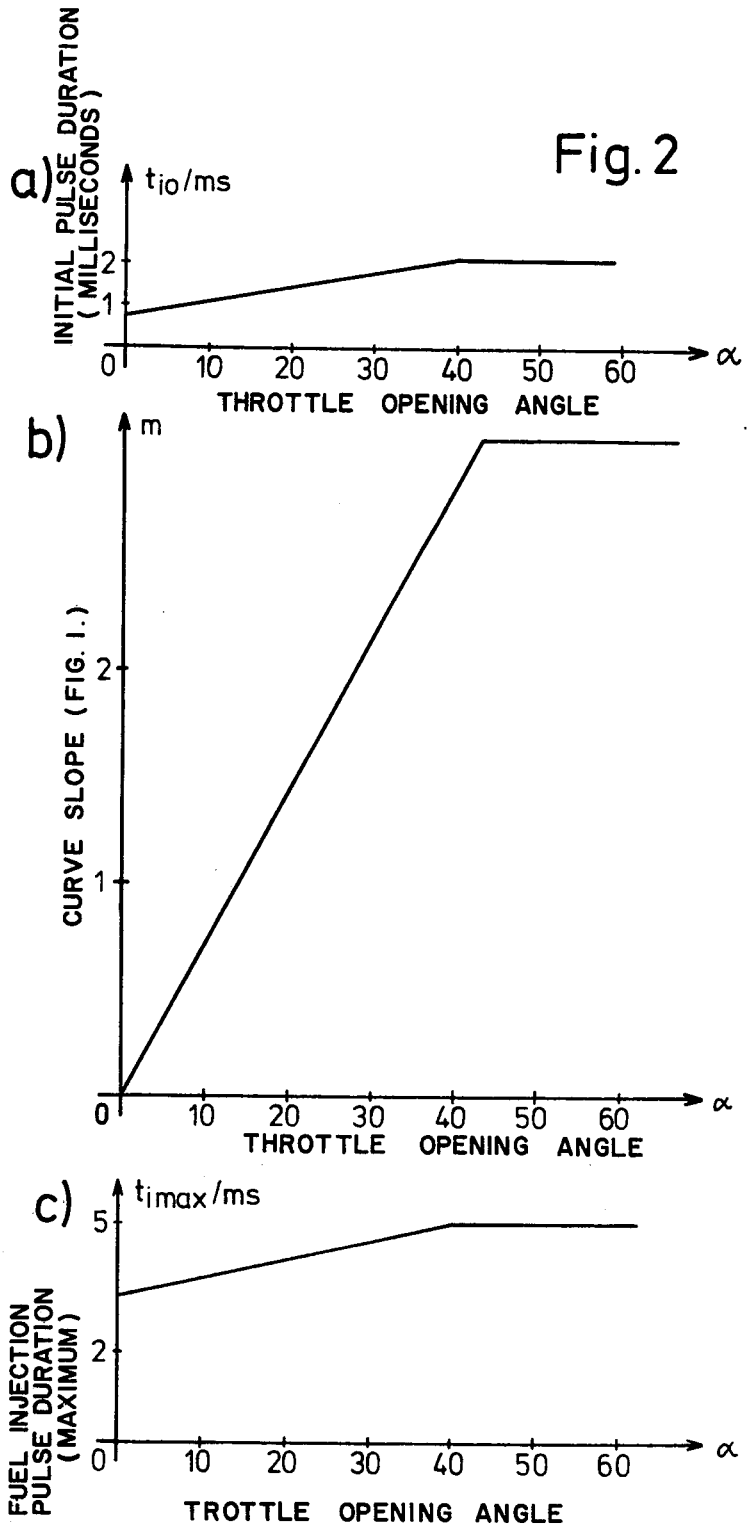
FIG. 2*a* is a diagram illustrating the initial values of the curves shown in FIG. 1 as a function of throttle angle.
FIG. 2*b* is a diagram illustrating the slope of the curves of FIG. 1 as a function of throttle angle.
FIG. 2*c* illustrates the maximum duration of the fuel control pulses as a function of throttle angle.

Turning now to FIG. 1, there will be seen illustrated a diagram showing a family of curves each of which designates the ideal, and optimum, empirically derived fuel injection control pulse duration in milliseconds as a function of engine period in milliseconds, the common parameter being the degree of throttle plate opening. In general terms, it may be seen that, for lower degrees of throttle opening, i.e. up to about 12 degrees, the injection pulse times increase monotonically whereas, for larger degrees of throttle opening, they enter a substantially horizontal region, for example between 15 degrees and 25 degrees and thereafter, as illustrated for the curves of 30 degrees and 40 degrees, the injection pulse times also include a decreasing portion following a substantially exponential curve subsequent, to the horizontal portion. Various features of this family of curves are separately plotted as a function of the parameter variable (throttle opening angle $\alpha$) in FIGS. 2*a*, 2*b*, and 2*c*. In particular, 2*a* illustrates the initial pulse duration of the family of curves of FIG. 1 as a function of throttle angle at zero period, i.e. at infinitely high engine speed. This curve illustrates that up to approximately 25 degrees of throttle angle opening, the initial pulse widths rise substantially, whereafter the rise is essentially negligible. FIG. 2*b* is a plot of the slope "m" of the curves in FIG. 1 as a function of throttle plate angle, where it will be seen that the slope increases linearly up to a throttle angle of approximately 43 degrees after which it remains constant. FIG. 2*c* illustrates the maximum duration of the fuel injection pulses as a function of throttle angle showing that this value also increases up to a throttle opening of about 40 degrees, whereafter it remains constant.

Figure 3:
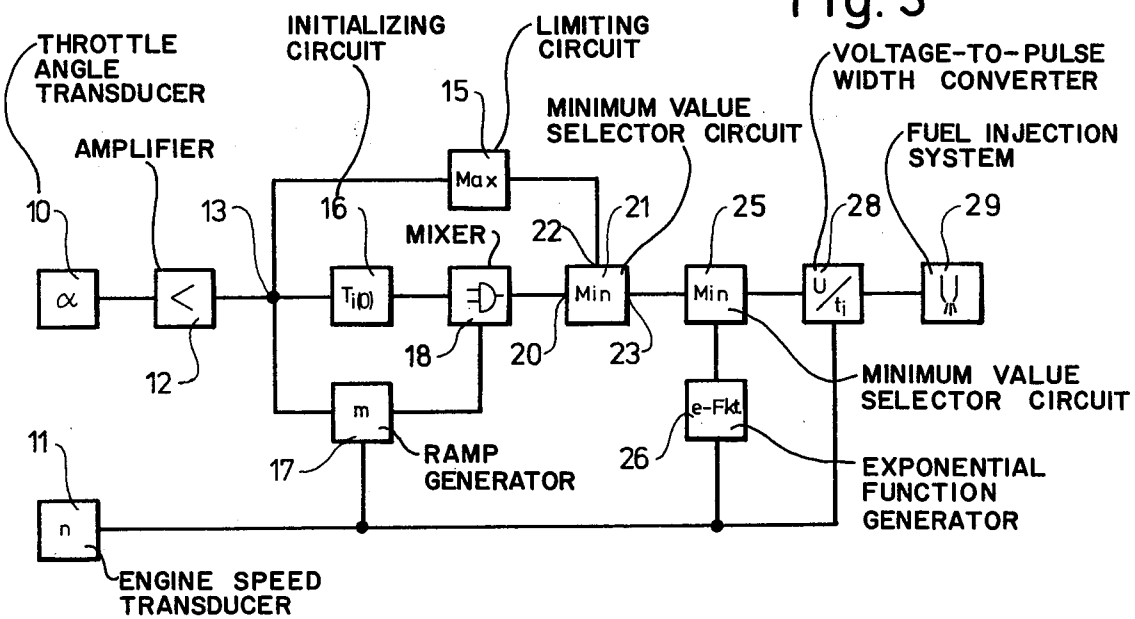
FIG. 3 is a block diagram illustrating a preferred exemplary embodiment of an apparatus for carrying out the invention.

FIG. 3 is a block diagram of an exemplary embodiment for carrying out the method of the invention, i.e. for determining the duration of fuel injection control pulses for an electronically controlled fuel injection system. The two basic engine variables which are monitored by appropriate transducers are the engine speed "n" and the throttle plate angle of opening "$\alpha$". The throttle plate opening angle $\alpha$ is detected by an appropriate transducer which generates a signal related to throttle angle $\alpha$, whereas an appropriate speed transducer or tachometer 11 generates signals related to engine speed. The throttle angle signal is fed to an amplifier 12 where it is increased in strength and carried to a circuit junction 13 from which various other components receive the amplified signal. The amplifier 12 is so constructed as to generate a constant signal when the throttle plate angle exceeds, for example, 40 degrees or 50 degrees. Connected to the junction 13 is a limiting circuit 15, an initializing circuit 16 and a ramp generator 17 which also receives the signal from the tachometer 11. The outputs of the initializer 16 and the ramp generator 17 are fed to respective inputs of a mixer 18 which forms the sum of these signals and applies it to the first input 20 of a minimum value selection circuit 21. A second input 22 of the minimum selector circuit receives the output from the limiting circuit 15 and the output 23 of the minimum selector 21 is applied to an input of a subsequent second minimum value selector circuit 25 which also receives a signal from an exponential function generator 26. The output of the second minimum value selector 25 is then applied to a voltage-to-pulse width converter 28 which, in turn, controls the action of a fuel injection system 29 and, in particular, controls the duration of opening of the fuel injection valves of the engine. The engine speed signals from the tachometer 11 are fed to the ramp generator 17, the exponential function generator 26, as well as the voltage-to-pulse width converter 28.

The apparatus illustrated in FIG. 3 operates as follows. The analog signal of the throttle angle transducer 10 is amplified in the amplifier 12 below an angle of approximately 50 degrees after which it is limited. The output signal of the amplifier 12 is used by the limiting circuit 15 to generate a maximum value related to the prevailing throttle valve angle according to the curve illustrated in FIG. 2*c*. Similarly, the initializer circuit 16 generates initial control pulse lengths according to the values illustrated in FIG. 2*a* and the ramp generator 17 generates a signal having the slope illustrated in FIG. 2*b*. The output signals of the initializer circuit 16 and the ramp generator 17 are then combined in the mixer 18, thereby generating the increasing curves illustrated in FIG. 1. The subsequent minimum value selector 21 then chooses a minimum value to generate the horizontal portions of the curves in FIG. 1. The breaks in the curves of FIG. 1 occur whenever the output signal of the mixer 18 is equal to the value of the output signal from the limiting circuit 15. The exponential portions of the curves in FIG. 1 are provided by the second minimum value selection circuit 25 which compares the signal from the first minimum selector 21 with the output signal of the exponential generator 26 and which comes into play for large throttle angles and relatively small engine speeds. The signal from the second minimum value selector 25 is then used as an input signal for the converter 28 which generates control pulses whose length depends on the magnitude of the input signal. At the same time, the output pulses from the converter 28 are synchronized with the signal from the tachometer 11.

Figure 4:
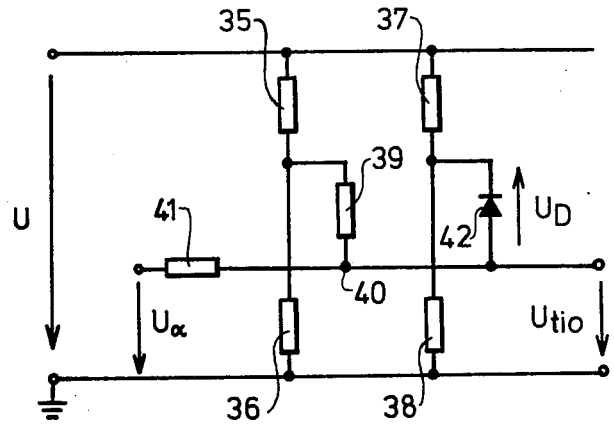
FIG. 4 is a series of three partial circuit diagrams illustrating three blocks in FIG. 3.
Figure 4:
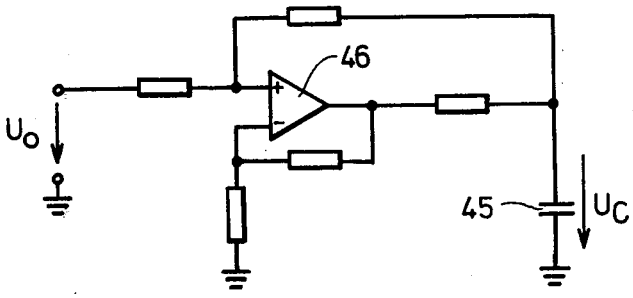
Figure 4:
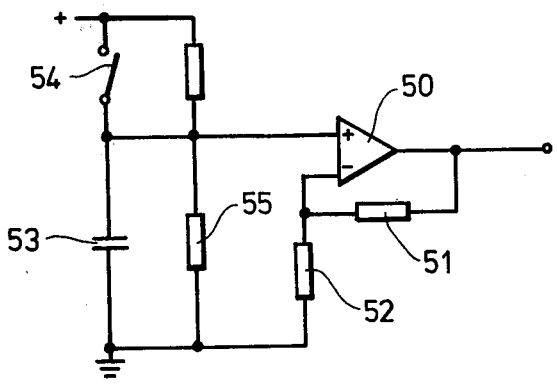

Three of the principal functional blocks of FIG. 3 are illustrated in FIGS. 4*a* to 4*c*. FIG. 4 illustrates an exemplary embodiment of an initializing circuit 16 as shown in FIG. 3. This circuit includes two voltage dividers having, respectively, resistor pairs 35, 36 and 37, 38. The junction of the resistors 35 and 36 is coupled through a further resistor 39 to an output line 40 which is connected to the input of the initializing circuit 16 via a resistor 41. The junction of the two resistors 37 and 38 is connected via a diode 42 to the same output bus 40. The function of the diode 42 is to hold the output value of the initializer substantially constant at large throttle plate angles, as illustrated in FIG. 2*a*. FIG. 4*b* is a circuit diagram of an example of a ramp generator to be used as block 17 in FIG. 3. The ramp generator includes a capacitor 45 and a constant current source 46, the magnitude of the charging current being defined by the input voltage to the amplifier.

FIG. 4*c* is a circuit diagram of an example of an exponential generator such as block 26 in FIG. 3. According to the curves of FIG. 1, it is desired that the exponential part of the curves become effective only after a certain time period has elapsed. The required delay is obtained in the circuit of FIG. 4*c* by a feedback-connected amplifier 50 with a feedback resistor 51 and in which a resistor 52 is connected from the inverting input to ground. A capacitor 53, which is periodically charged by means of a switch 54, serves to generate the exponential function. The capacitor 53 can be discharged through a resistor 55.

After the capacitor 53 is fully charged, and the switch 54 opens, the capacitor discharges according to an exponential function through the resistor 55. The feedback connection of the amplifier 50 serves to insure that the decreasing voltage at the capacitor 53 is not immediately transferred to the output of the amplifier 50 but only after having fallen below a predetermined value. This value is adjustable by adjusting the degree of feedback by means of adjusting the resistance value of the resistors 51 and 52. The result is an output which produces the desired delayed decreasing exponential function of FIG. 1.

Figure 5:
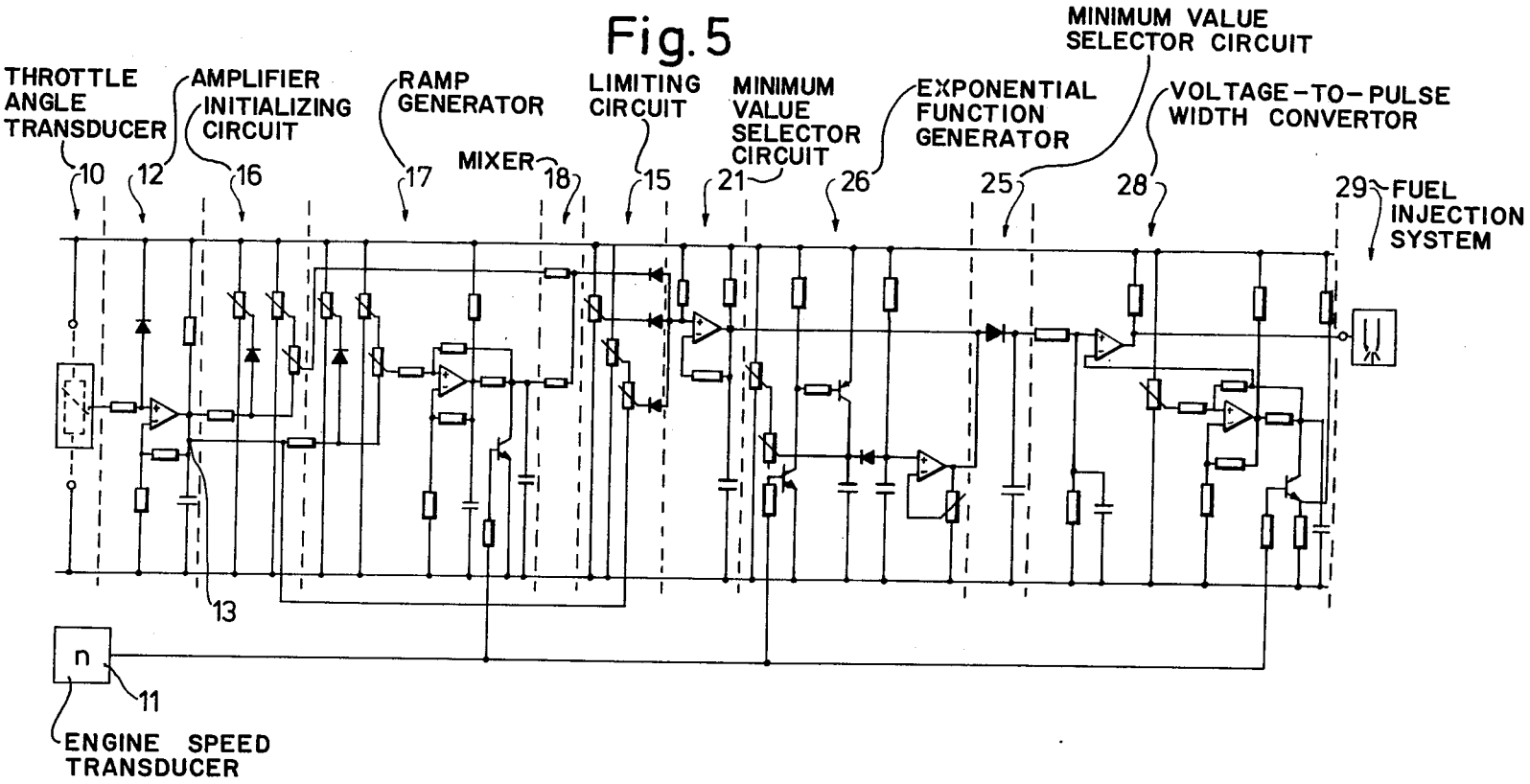
FIG. 5 is a complete circuit diagram of the preferred exemplary embodiment of the invention.

FIG. 5 is a complete and detailed circuit diagram of the apparatus according to the present invention. In FIG. 5, the sections of the circuit separated by dashed lines correspond to those illustrated as blocks in FIG. 3. Several of these blocks have previously been discussed in detail. In this preferred embodiment, the limiting circuit 15 is seen to include a resistor-diode network. The minimum value selection circuit 25 is seen to include an AND gate circuit and a voltage peak rectifier.

The embodiment illustrated in detail in FIG. 5 is intended to represent a particular practical exemplary embodiment of the invention. A detailed discussion of the connections in this example of FIG. 5 is not believed to be necessary inasmuch as the invention relates primarily to the overall manner of generating fuel injection control pulses, however. Furthermore, all examples described and illustrated in the present invention are given by way of a preferred embodiment but are not intended to be limited thereto, it being especially understood that other embodiments and variants which substantially perform the method described herein are intended to be within the spirit and scope of the invention.

What is claimed and desired to be secured by Letters Patent of the United States is:

1. An apparatus for defining the duration of fuel injection control pulses in the fuel injection system of an internal combustion engine, said system including an engine speed transducer and a throttle plate opening angle transducer comprising, in combination, an initial value generator connected to said throttle plate opening angle transducer and to said engine speed transducer for defining the initial duration of said fuel injection control pulses, a ramp generator connected to said engine speed transducer for generating the increasing portion of the function defining the duration of said fuel injection control pulses, a limiter circuit connected to said throttle plate opening angle transducer and to said engine speed transducer for limiting the duration of said fuel injection control pulses in dependence on the signals from said transducer wherein th signal from said throttle plate opening angle transducer is fed to said limiter circuit, to said initial value generator and to said ramp generator and a first minimum value selector for selecting the smaller one of the signals from said limiter circuit and the sum of the signals from said initial value generator and said ramp generator.

2. An apparatus as defined by claim 1, further comprising an exponential function generator and a second minimum value selector connected to receive the output from said first minimum value selector and the output from the exponential function generator, for selecting the smaller of these.

3. An apparatus as defined by claim 2, wherein the exponential function generator includes a capacitor and circuit means for periodically charging and discharging said capacitor.

4. An apparatus as defined by claim 1, further comprising an amplifier connected behind said throttle plate opening angle transducer, said amplifier delivering a constant output signal when the throttle plate angle exceeds approximately 50°.

5. An apparatus as defined by claim 1, wherein said ramp generator includes a constant current source, connected to charge a capacitor.

6. An apparatus as defined by claim 1 wherein the duration of said fuel injection control pulses is defined by a plurality of joined linear segments which approximate an empirically derived optimum curve.

* * * * *